United States Patent [19]

Manz

[11] Patent Number: 4,729,688

[45] Date of Patent: Mar. 8, 1988

[54] MULTI-RING LOOSE LEAF BINDER AND PORTABLE PAPER PUNCH THEREFOR

[76] Inventor: August F. Manz, 470 Whitewood Rd., Union, N.J. 07083

[21] Appl. No.: 51,658

[22] Filed: May 20, 1987

[51] Int. Cl.[4] ..... B42F 3/04; B42F 13/22

[52] U.S. Cl. ..... 402/1

[58] Field of Search ..... 402/1, 802; 30/358, 30/361, 366, 368

[56] References Cited

U.S. PATENT DOCUMENTS

| | | | |
|---|---|---|---|
| 1,107,658 | 8/1914 | Cooke, Jr. | 402/1 |
| 1,200,588 | 10/1916 | Cooke, Jr. | 402/1 |
| 1,871,597 | 8/1932 | English | 30/358 X |
| 2,782,856 | 2/1957 | Staley | 402/1 X |
| 3,340,625 | 9/1967 | Supitilov | 30/358 X |
| 3,975,105 | 8/1976 | Cline | 402/1 |
| 4,020,554 | 5/1977 | LaTourette | 30/358 |
| 4,669,191 | 6/1987 | Schramm | 30/366 |

*Primary Examiner*—Paul A. Bell

*Attorney, Agent, or Firm*—John R. Doherty

[57] ABSTRACT

A portable paper punch comprising a pair of substantially flat, juxtaposed members having therein a multiplicity of holes arranged in a position in which is identical to the pattern of holes to be punched in a sheet of loose leaf paper, and means for securing the flat, juxtaposed members together in a fixed, spaced apart relation with the pattern of holes in one member registering with the pattern of holes in the opposite member, the arrangement being such that when inserted in the space between the members, the sheet of loose leaf paper can be provided with the same pattern of holes by forcing a sharp object through each pair of registered holes in the members.

17 Claims, 5 Drawing Figures

FIG. 2
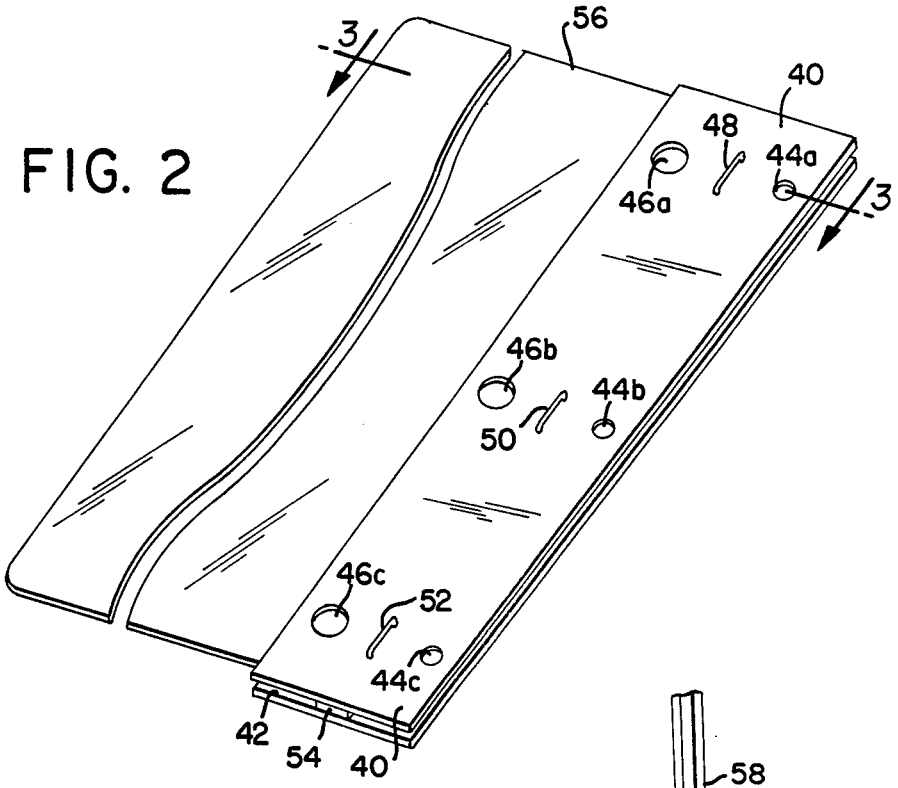
FIG. 3
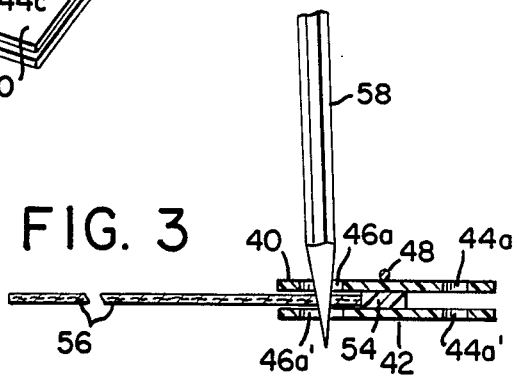
FIG. 4
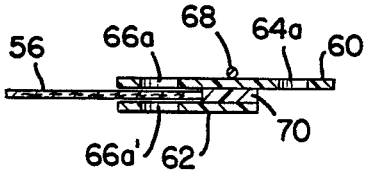
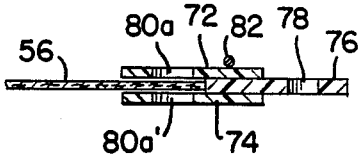
FIG. 5

MULTI-RING LOOSE LEAF BINDER AND PORTABLE PAPER PUNCH THEREFOR

FIELD OF THE INVENTION

This invention relates to a multi-ring, loose leaf binders and more particularly to a portable paper punch for use with such binders.

BACKGROUND OF THE INVENTION

There is a proliferation of multi-ring, loose leaf binder designs with various shaped rings, ring sizes, number of rings and ring spacings. Paper is also available with a multiplicity of prepunched holes arranged to mate with the rings of a particular binder. On occasion, when additional paper having the prepunched holes is not available or the binder user needs to insert a special piece of paper, a multi-hole paper punch is usually employed to provide the desired number of holes in the paper.

Manually operated, multi-hole, paper punches have been commercially available for some time now. However, these punches are usually quite large and bulky and they do not lend themselves to be easily and conveniently stored and carried in small bookcases, briefcases and the like. Moreover, they can be difficult to use and are easily misplaced or lost.

Almost everyone who has used a loose leaf binder has at times been faced with the problem of inserting into the binder a page which does not include prepunched holes. It is customary in such instances to provide the required holes by simply pushing the paper over the ends of open binder rings. Such a method, while expedient, is ordinarily unreliable since the edge of the paper frequently tears or the holes are off center.

Another method used to provide the required holes is to mark the position of the holes on the paper and then pierce the paper at the market locations with a pencil or other sharp object. However, this method is also crude, unreliable and time consuming.

It is therefore an important object of this invention to provide a handy, reliable and easy to use, multi-hole, portable paper punch.

Another more specific object of this invention is to provide a novel combination of a multi-ring, loose leaf binder and a portable paper punch which can be stored and carried inside the binder and which can be easily and conveniently used without removing it from the binder.

DESCRIPTION OF THE INVENTION

The invention is directed to a novel portable paper punch for use with a standard multi-ring, loose leaf binder. Typically, the binder is composed of two rectangular cover panels hingeably secured to an elongated rectangular back panel. A binder post assembly including a plurality of binder rings and a snap-action, locking mechanism for opening and closing the binder rings is mounted on the inside of the back panel.

Broadly, the portable paper punch comprises a pair of thin, rigid or semi-rigid, substantially flat, parallel members which are spaced apart from each other a sufficient distance to enable at least a single sheet of paper to be inserted therebetween. Each of the flat, parallel members is provided with a multiplicity of holes which register with a multiplicity of holes in the opposite member. The multiplicity of holes in each member are arranged such that pairs of the registered holes mate with the plurality of binder rings which are held on the binder post assembly. Means are provided for holding the pair of flat, parallel members in fixed relation to one another and for securing the members to the binder post assembly.

To operate the punch, the user need only insert a sheet of paper in the space between the pair of flat, parallel members and then push a sharp object such as a pencil through each pair of registered holes to pierce the paper.

BRIEF DESCRIPTION OF THE DRAWING

The invention will now be described in greater detail with reference to the accompanying drawing wherein:

FIG. 2 is a perspective view of the portable paper punch employed in the loose leaf binder of FIG. 1, showing a sheet of paper inserted into the space between the two flat, parallel members and ready to be punched;

FIG. 3 is a cross-sectional view of the punch taken along the line 3—3 of FIG. 2 and showing the point of a pencil piercing through the sheet of paper;

FIG. 4 is a cross-sectional view of a modification of the portable paper punch; and FIG. 5 is a similar view of another modification of the punch.

DESCRIPTION OF THE PREFERRED EMBODIMENTS

Figure 1:
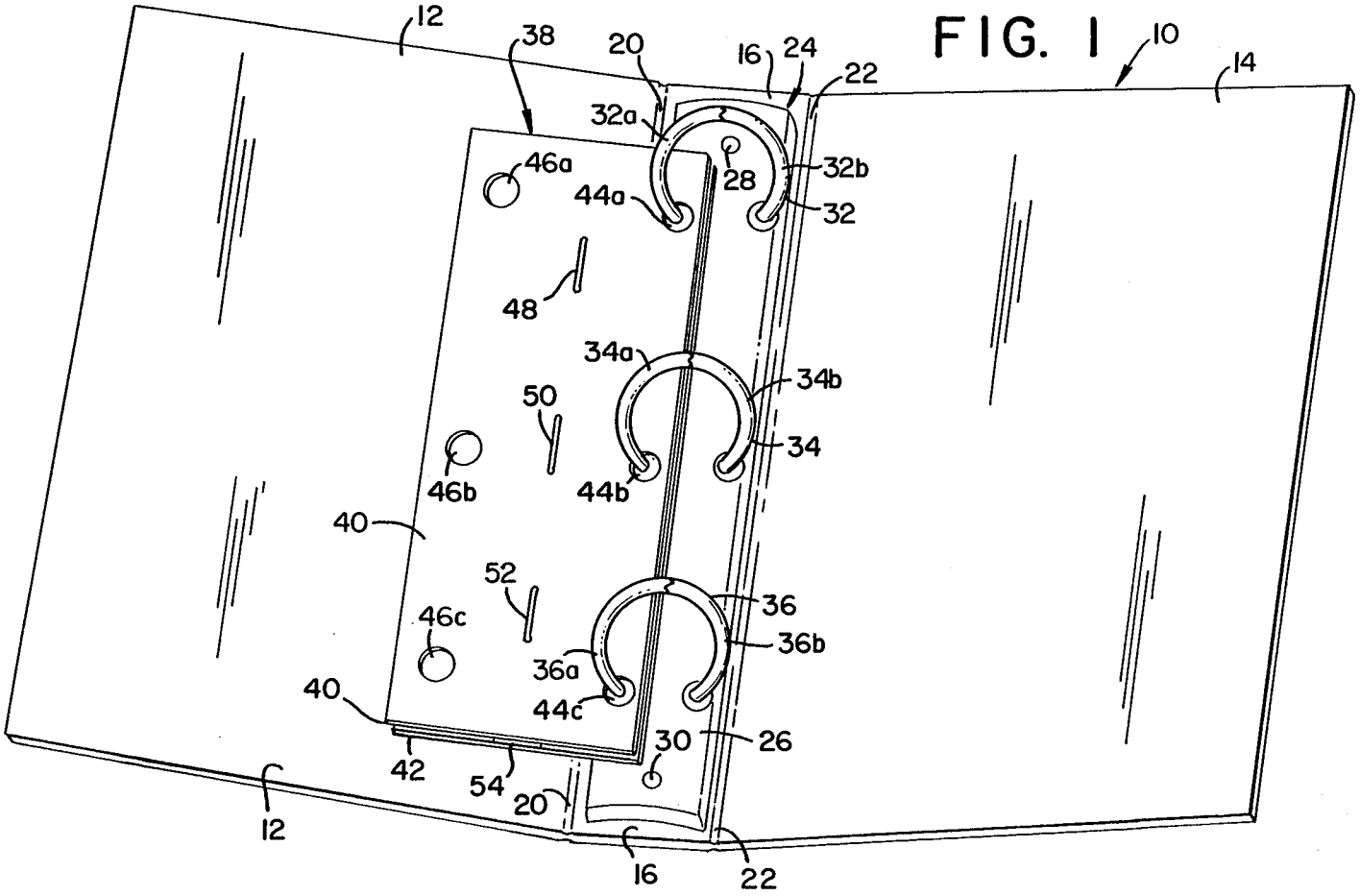
FIG. 1 is a perspective view of an opened multi-ring, loose leaf binder embodying the invention.

Referring to the drawing, a multi-ring, loose leaf binder embodying the invention is shown in FIG. 1. As shown, the binder includes a cover 10 composed of two substantially flat, rectangular side panels 12, 14 and an elongated, narrow, rectangular back panel 16. The two side panels 12, 14 are secured to the back panel 16 in the usual manner by two flexible binding hinges 20, 22. The cover 10 is preferably made by folding a sheet of paperboard or the like into three rectangular sections corresponding to the two side panels 12, 14 and the back panel 16. The two fold lines separating the three sections serve as the flexible hinges 20, 22 for securing the panels together.

Mounted to the interior side of the back panel 16 is a multi-ring, binder post assembly 24. The binder post assembly 24 includes an elongated, rigid, hollow, metal casing 26 which is secured to the back panel 16 by two rivet fasteners 28, 30.

The casing 26 includes a conventional snap-action, ring locking mechanism (not shown) for simultaneously opening and closing a plurality of circular binder rings which extend outwardly from the casing 26. In the embodiment of the loose-leaf binder illustrated, there are three such rings 32, 34 and 36 employed, the two outer rings 32 and 36 being equally spaced apart from the center ring 34.

Each of the rings 32, 34 and 36 is split into two semicircular half sections as shown at **34*a* and 34*b*, for example, in the case of the center ring 34. The ring sections can be pulled apart and snapped together again using the fingers in the usual manner in order to open and close the rings. The snap-action, ring locking mechanism used in the casing 26** actually forms no part of the present invention and any conventional design that is capable of holding the ring half sections in either the open or closed position can be employed.

It will also be understood that the binder post assembly 24 may employ any number of binder rings aside from the three rings 32, 34 and 36 shown in the embodiment of Figure 1. The number of binder rings as well as the spacing employed between the rings determines the "hole pattern" for the loose leaf paper (not shown) that is used in a particular binder assembly.

Removeably attached to the loose leaf binder is the portable paper punch 38 according to the invention. The punch 38 includes a pair of thin, rigid or semi-rigid, substantially flat, elongated, rectangular, parallel members 40, 42 made from heavy paperboard or a plastic sheet material, for example.

The top parallel member 40 is provided with two sets of three prepunched holes, namely, a first set of holes 44*a*, 44*b* and 44*c*, and a second set of holes 46*a*, 46*b* and 46*c*. The bottom parallel member 42 is similarly provide with two sets of holes only one of which from each set, namely holes 44*a*' and 46*a*', are visible in the view of FIG. 3.

The first set of holes 44*a*, 44*b* and 44*c* are arranged in a row along the longitudinal edge of the top member 40 which is closest to the binder post assembly 24. Similarly, the first set of holes in the bottom member 42 (only one of which is shown at 44*a*' in FIG. 3) are arranged in a parallel row along the same longitudinal edge of the bottom member 42.

The spacing between the first set of holes in the top member 40 is the same as the spacing between the first set of holes in the bottom member 42 so that pairs of corresponding holes from each set register with one another as shown, for example, by the pair of holes 44*a*, 44*a*' in the view of FIG. 3. There are, of course, three such pairs of registered holes in the embodiment of the punch illustrated.

The spacing between the pairs of holes in the top and bottom members 40, 42 is the same as the spacing between the binder rings 32, 34 and 36 on the post assembly. This spacing is also identical to the spacing used in the "hole pattern" of the loose leaf paper. The binder rings pass through the pairs of registered holes in the top and bottom members 40, 42 and secure the punch in place on the post assembly 24.

The second set of holes 46*a*, 46*b* and 46*c* are arranged in a row along the opposite longitudinal edge of the top member 40 which is farthest from the post assembly 24. In a similar fashion, the second set of holes in the bottom member 42 (only one of which is shown at 46*a*' in the view of FIG. 3) are arranged in a parallel row along the same opposite longitudinal edge of the bottom member 42.

The spacing between the second set of holes in the top member 40 is the same as the spacing between the second set of holes in the bottom member 42 so that pairs of corresponding holes from each set register with one another as shown, for example, by the pair of holes 46*a*, 46*a*' in the view of FIG. 3. Again, there are three such pairs of registered holes in the embodiment of the punch illustrated.

The spacing between these three pairs of holes in the top and bottom members 40, 42 is the same as the spacing between the binder rings 32, 34 and 36. This spacing is also identical to the spacing employed in the "hole pattern" of the loose leaf paper.

The top and bottom members 40, 42 are held securely together by means of three staple fasteners 48, 50 and 52. These fasteners pass through a barrier or spacer 54 which is placed between and along the longitudinal center line of the top and bottom members 40, 42. The barrier or spacer 54 keeps the two members a proper distance apart to allow for the insertion of at least a single sheet of paper as shown, for example, at 56 in FIGS. 2 and 3. In addition, the barrier or spacer 54 acts as "depth gage" to insure that the paper is inserted a proper distance into the punch.

The portable punch of the invention functions in the following manner: The sheet of paper 56 to be punched is inserted into the space defined between the top and bottom members 40, 42 as shown in FIGS. 2 and 3. The paper is placed a sufficient distance into the space so that the edge to be punched contacts the barrier or spacer 54 which acts as a depth gage. Using the fingers, pressure is applied to the top and bottom members 40, 42 to hold the paper firmly in position. A pointed object, such as a pencil 58, is then forced through each pair of registered holes, e.g. holes 46*a*, 46*a*', along the farthest edge of the two members 40, 42, piercing holes in the paper to provide the required "hole pattern" for use in the binder. In the case where the hole diameter is larger than than that of the pointed object, eg. the pencil 58, the object may be moved about in the hole to enlarge it before it is withdrawn. Once the "hole pattern" is complete, the sheet of paper 56 is withdrawn from the punch and is ready for placement in the binder. Instructions for use in the form of pictograms, for example, can be printed on the punch for convenience.

An important feature of the invention is the provision of means for securing the top and bottom members 40, 42 together and for preventing misalignment of the members and the pairs of registered holes. This is achieved in the embodiment illustrated by the staple fasteners 48, 50 and 52. However, other equivalent means can, of course, be used such as rivets, plastic welds in the case where the top and bottom members are made of plastic, or glue. It is also possible to fabricate the juxtaposed flat members in one piece by folding a large sheet of heavy paperboard or plastic in half to form a generally U shaped configuration.

The two flat, juxtaposed members of which the punch is made are not required to be the same size. One member can be made larger in area than the other in order to conserve material of construction and to decrease the weight of the punch. Only enough juxtaposed area is needed for the two members to provide space for the desired hole pattern or patterns.

FIG. 4 shows a modification of the portable paper punch wherein the top member 60 is made larger than the bottom member 62 and wherein only the top member 60 is provided with a first set of holes as shown at 64*a* for securing the punch onto the binder post assembly. Both the top and bottom members are each provided as before with a set of holes which register with one another as at 66*a* and 66*a*'. Staple fasteners hold the two members together as shown at 68, separated by the spacer 70.

Another modification of the punch is shown in FIG. 5. Here the top and bottom members 72, 74 are the same size but the spacer 76 in this case extends outwardly from between the two members and is provied with holes as at 78 for securing the punch onto the binder post assembly. Again, the top and bottom members 72, 74 are each provided with a set of holes which register with one another as shown at 80*a* and 80*a*'. The two members and the spacer 76 are held together by staple fasteners as a at 82.

It is also possible to provide a number of hole patterns to create a multi-purpose hole punch and to provide holes for accomodating the storage of the punch in multi-ring binders of different sizes. In binder designs which employ a flat plastic paper lift member, the punch of the invention can also serve that function as well. Such multi purpose use can significantly reduce the cost of incorporating the punch into the binder.

Other modifications of the portable punch of the invention are, of course, possible and will readily occur to those skilled in the art. For example, the depth gage function can be acheived by means other than the barrier or spacer 24 such as by use of the staple fasteners alone.

The portable punch of the invention can be easily stored in a multi-ring binder along with loose leaf paper, paper lifters (when not combined with the punch), paper separators or the like, without adding any undesirable bulk or introducing any inconvenience to the user by its presence. The punch can be used while it is affixed to the binder or it can be removed and employed separately to punch a desired hole pattern in loose leaf paper.

What is claimed is:

1. In a loose leaf binder including a cover having back and side panels and a binder post assembly mounted onto the back panel for holding a stack of loose leaf paper inside said cover, said binder post assembly including a multiplicity of binder rings adapted to pass through a plurality of spaced apart, prepunched holes provided in the loose leaf paper along a longitudinal edge thereof; the combination therewith of a portable paper punch comprising:

(a) a pair of substantially flat, juxtaposed members, each of said members having therein a multiplicity of holes arranged in a pattern which is identical to the pattern of holes to be formed in the loose leaf paper;

(b) means for securing said flat, juxtaposed members together in a fixed, spaced apart relation with the pattern of holes in one member registering with the pattern of holes in the opposite member, the arrangement being such that a sheet of loose leaf paper inserted in the space between said members can be punched with the same pattern of holes by forcing a sharp object through the corresponding pairs of holes in said members; and (c) means for removably attaching said pair of flat, juxtaposed members onto said binder post assembly.

2. The loose leaf binder according to claim 1 wherein the pair of flat, juxtaposed members are secured together in a fixed, spaced apart relation by means of staple fasteners which pass through said members.

3. The loose leaf binder according to claim 2 wherein a spacer is positioned between said members and is held in place by said fasteners, said spacer acting as a depth gage for the placement of loose leaf paper between said members.

4. The loose leaf binder according to claim 3 wherein the spacer extends outwardly from between said members and is provided with a multiplicity of holes arranged to coincide with the binder rings and comprising said removably attaching means and wherein said binder rings pass through said holes for removably attaching said punch onto said post assembly.

5. The loose leaf binder according to claim 1 wherein at least one of said flat, juxtaposed members is provided with a multiplicity of holes arranged to coincide with the binder rings and comprising said removably attaching means, and wherein said binder rings pass through said holes for removably attaching said punch onto said post assembly.

6. The loose leaf binder according to claim 5 wherein both of said flat, juxtaposed members are provided with a multiplicity of holes arranged to coincide with the binder rings, the multiplicity of holes in one member being in registration with the multiplicity of holes in the other member so that said binder rings pass through pairs of holes in both members for removably attaching said punch onto said post assembly.

7. A portable paper punch for punching a predetermined pattern of holes in loose leaf paper comprising, in combination: a pair of substantially flat, juxtaposed members, each of said members having therein a multiplicity of holes arranged in a pattern which is identical to said predetermined pattern, and means for securing said flat, juxtaposed members together in a fixed, spaced apart relation with the pattern of holes in one member registering with the pattern of holes in the opposite member, the arrangement being such that when inserted in the space between a members, said sheet of loose leaf paper can be provided with the predetermined pattern of holes by forcing a sharp object through the corresponding pairs of holes in said members.

8. The portable paper punch according to claim 7 wherein the pair of flat, juxtaposed members are secured together in a fixed, spaced apart relation by means of staple fasteners which pass through said members.

9. The portable paper punch according to claim 8 wherein a spacer is positioned between said members and is held in place by said fasteners, said spacer acting as a depth gage for the placement of loose leaf paper between said members.

10. The portable paper punch according to claim 9 wherein means are provided for removably attaching said pair of flat, juxtaposed members onto the binder rings of a multi-ring, loose leaf binder assembly.

11. The portable paper punch according to claim 10 wherein one of said flat, juxtaposed members is provided with a multiplicity of holes comprising said removably attaching means.

12. The portable paper punch according to claim 10 wherein both of said flat, juxtaposed members are provided with a multiplicity of holes for passage of said binder rings therethrough.

13. The portable paper punch according to claim 10 wherein the spacer extends outwardly from between said members and is provided with a multiplicity of holes comprising said removably attaching means.

14. A portable paper punch for punching a predetermined pattern of holes in loose leaf paper comprising, in combination:

(a) a pair of substantially flat, juxtaposed members, each of said members having therein (i) a first multiplicity of holes arranged along a longitudinal edge thereof in a pattern which is identical to said predetermined pattern, and (ii) a second multiplicity of holes arranged along an oppposite edge of at least one of said members which holes are adapted to coincide with the binder rings of a multi-ring, loose leaf binder assembly, and (b) means for securing said flat, juxtaposed members together in a fixed, spaced apart relation with the first multiplicity of holes in one member registering with the first multiplicity of holes in the opposite member, the arrangement being such that when inserted in the space between said members, a sheet of loose leaf paper can be provided with the predetermined pattern of holes by forcing a sharp object through corresponding pairs of holes in said members.

15. The portable paper punch according to claim 14 wherein the means for securing the pair of flat, juxtaposed members together in a fixed, spaced apart relationship comprise staple fasteners which pass through said members.

16. The portable paper punch according to claim 15 wherein a spacer is positioned between said members and is held in place by said fasteners, said spacer acting as a depth gage for the placement of loose leaf paper between said members.

17. The portable paper punch according to claim 14 wherein both of said flat, juxtaposed members are provided with a multiplicity of holes which are adapted to coincide with the binder rings of a multi-ring, loose leaf binder assembly.

* * * * *